US006067676A

United States Patent [19]

Carnahan et al.

[11] Patent Number: 6,067,676

[45] Date of Patent: May 30, 2000

[54] PLAYYARD WITH A DOOR

[75] Inventors: Michael Carnahan, Bedford; Robert J. Warner, Jr., Akron, both of Ohio

[73] Assignee: Graco Children's Products Inc., Elverson, Pa.

[21] Appl. No.: 09/176,409

[22] Filed: Oct. 20, 1998

[51] Int. Cl.[7] ..... A47D 13/06; A47D 7/00; E04H 15/40; E04H 15/44

[52] U.S. Cl. ..... 5/99.1; 5/98.1; 5/97; 5/416; 135/117; 135/116; 135/128; 403/328

[58] Field of Search ..... 5/93.1, 98.1, 99.1, 5/97, 416, 414; 403/109.2, 109.3, 328; 135/121, 128, 138, 141, 142, 157, 158, 116, 117, 87; 43/1

[56] References Cited

U.S. PATENT DOCUMENTS

| | | | |
|---|---|---|---|
| 498,245 | 5/1893 | De Laney | 5/98.1 X |
| 528,391 | 10/1894 | Rinn | 135/117 X |
| 528,392 | 10/1894 | Rinn | 135/117 X |
| 528,393 | 10/1894 | Rinn | 135/117 X |
| 528,394 | 10/1894 | Rinn | 135/117 X |
| 2,917,059 | 12/1959 | Emanuelson | 135/116 X |
| 2,931,373 | 4/1960 | Larson | 135/116 X |
| 2,979,064 | 4/1961 | Fischer | 135/117 X |
| 3,165,760 | 1/1965 | Abajian | 5/99.1 X |
| 3,282,274 | 11/1966 | Scott | 135/142 |
| 3,356,098 | 12/1967 | Krutzikowsky | 135/117 X |
| 3,515,426 | 6/1970 | Gerber | 135/117 X |
| 3,540,458 | 11/1970 | Osterhoudt et al. | 135/117 X |
| 3,547,136 | 12/1970 | Prinz et al. | 135/116 X |
| 3,874,397 | 4/1975 | Oberhaus | 135/117 X |
| 4,000,749 | 1/1977 | Busco | 135/117 X |
| 4,015,297 | 4/1977 | Christian | 5/97 |
| 4,072,158 | 2/1978 | O'Brien et al. | 135/87 X |
| 4,077,417 | 3/1978 | Beavers | 135/117 X |
| 4,304,068 | 12/1981 | Beder | 135/117 X |
| 4,607,655 | 8/1986 | Wagner et al. | 135/116 X |
| 4,641,387 | 2/1987 | Bondy et al. | 5/97 X |
| 4,731,627 | 3/1988 | Chisholm | 135/87 X |
| 4,796,314 | 1/1989 | Garduno | 5/98 A |
| 4,811,437 | 3/1989 | Dillner et al. | 5/99 B |
| 4,825,484 | 5/1989 | Riegel | 5/97 |
| 4,862,534 | 9/1989 | Gomez-Marcial | 5/414 |
| 4,938,243 | 7/1990 | Foster | 135/128 X |
| 5,007,212 | 4/1991 | Fritts et al. | 135/116 X |
| 5,161,269 | 11/1992 | McLean et al. | 5/414 |
| 5,301,705 | 4/1994 | Zheng | 135/128 X |
| 5,339,470 | 8/1994 | Shamie | 5/98.1 |
| 5,343,887 | 9/1994 | Danaher | 135/128 X |
| 5,439,018 | 8/1995 | Tsai | 135/116 X |
| 5,467,794 | 11/1995 | Zheng | 135/125 |
| 5,533,215 | 7/1996 | Malofsky et al. | 5/99.1 |
| 5,579,799 | 12/1996 | Zheng | 135/117 X |
| 5,592,961 | 1/1997 | Chin | 135/117 X |
| 5,727,265 | 3/1998 | Ziegler et al. | 5/99.1 |
| 5,752,283 | 5/1998 | Arens | 5/99.1 |
| 5,765,584 | 6/1998 | Heisler et al. | 135/117 X |
| 5,779,386 | 7/1998 | Eichhorn | 403/328 X |

OTHER PUBLICATIONS

Pisolo advertisement, 1 page, (1998).

Fairland Baby Carriages Co., Ltd., Taiwan, "Accessories for Travel Playard" advertisement, 2 pages, (1998).

*Primary Examiner*—Terry Lee Melius
*Assistant Examiner*—Robert G. Santos
*Attorney, Agent, or Firm*—Foley & Lardner

[57] ABSTRACT

A playyard (10) includes a floor (12) and side panels (20) extending upwardly from the floor to provide an enclosure. At least one of the side panels has an opening (26) therethrough which is selectively covered by a pivotal door panel (30) to preclude access to and from the enclosure. The door panel (30) has a pair of retractable, spring-biased tube assemblies (40) that engage corners (16) which interconnect rails (18) that support the side panels.

10 Claims, 6 Drawing Sheets

PLAYYARD WITH A DOOR

TECHNICAL FIELD

This invention relates to a child's playyard. Particularly, this invention relates to a child's playyard that is convertible between an enclosed playyard and a play area which allows the child to enter and exit at will. Specifically, this invention relates to a playyard with an opening through a side panel which may be selectively covered by a door panel.

BACKGROUND ART

Collapsible playyards or cribs are employed to provide an enclosed area in which an infant or toddler may be placed to sleep or play. These collapsible playyards have side rails which "fold" in half to allow for storage and/or portability. Playyards are mostly used for infants as a sleeping crib or to allow a caregiver to do other tasks and ensure that the infant stays out of trouble.

When infants get older, these portable playyards are not ideally suited as a play area. Accordingly, their useful life is somewhat limited. Moreover, as an infant becomes a toddler, they may be able to climb out on their own, thus defeating the purpose of the enclosure.

To provide more functionality for these playyards, it is known to provide a zippered panel to allow the child to crawl in and out of the playyard and thus allow conversion into a play area. Unfortunately, these zippered-panel play areas can be opened and closed at will by the toddler, which may be an undesirable feature for some caregivers, inasmuch as the toddler can leave the enclosure without the caregiver being aware. Still yet another drawback of such a play area is that the child may not completely open the zippered-panel and become entrapped.

Thus, the need exists for a convertible playyard which is convertible between an enclosed playyard and an accessible playyard. Further, a need exists for a playyard that is easily assembled by the caregiver, but not the toddler.

DISCLOSURE OF THE INVENTION

It is thus an object of the present invention to provide a playyard that can be used as an enclosed playyard or as a child accessible playyard.

It is another object of the present invention to provide a playyard, as above, which is convertible only by a caregiver.

It is yet another object of the present invention to provide a playyard, as above, in which one of the side panels of the enclosure is provided with an opening.

It is an additional object of the present invention to provide a playyard, as above, in which a hinged door panel is provided to selectively cover the opening.

It is still yet another object of the present invention to provide a playyard, as above, in which a tube assembly is provided on each side of the hinged door panel to provide structural support for when the door covers the opening.

It is still an additional object of the present invention to provide a playyard, as above, in which the tube assembly includes a spring-loaded plunger that engages a playyard corner that connects the side rails of the playyard.

It is yet an additional object of the present invention to provide a retraction assembly within the tube assembly to allow disengagement of the tube assembly from the playyard corner.

Still a further aspect of the present invention is to provide a playyard, as above, in which the door has a half zipper that is mateable with a half zipper on the top exterior of the side panel with the opening.

These and other objects of the present invention, as well as the advantages thereof over existing prior art forms, which will become apparent from the description to follow, are accomplished by the improvements hereinafter described and claimed.

In general, a playyard which is convertible between an enclosed structure and an accessible play area includes a floor with side panels extending upwardly therefrom. At least one of the side panels has an opening therethrough, wherein a pivotable door panel selectively covers the opening to preclude access to and from the enclosure. In an open position, the door panel lays substantially flat on the floor of the playyard. In a closed position, the door panel covers substantially all of the side panel with the opening. The door panel is provided with tube assemblies which are spring-biased and fit in the playyard corners that connect the side rails of the enclosure. The tube assemblies are provided with a retractable feature that can only be operated by a caregiver.

A preferred exemplary playyard incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
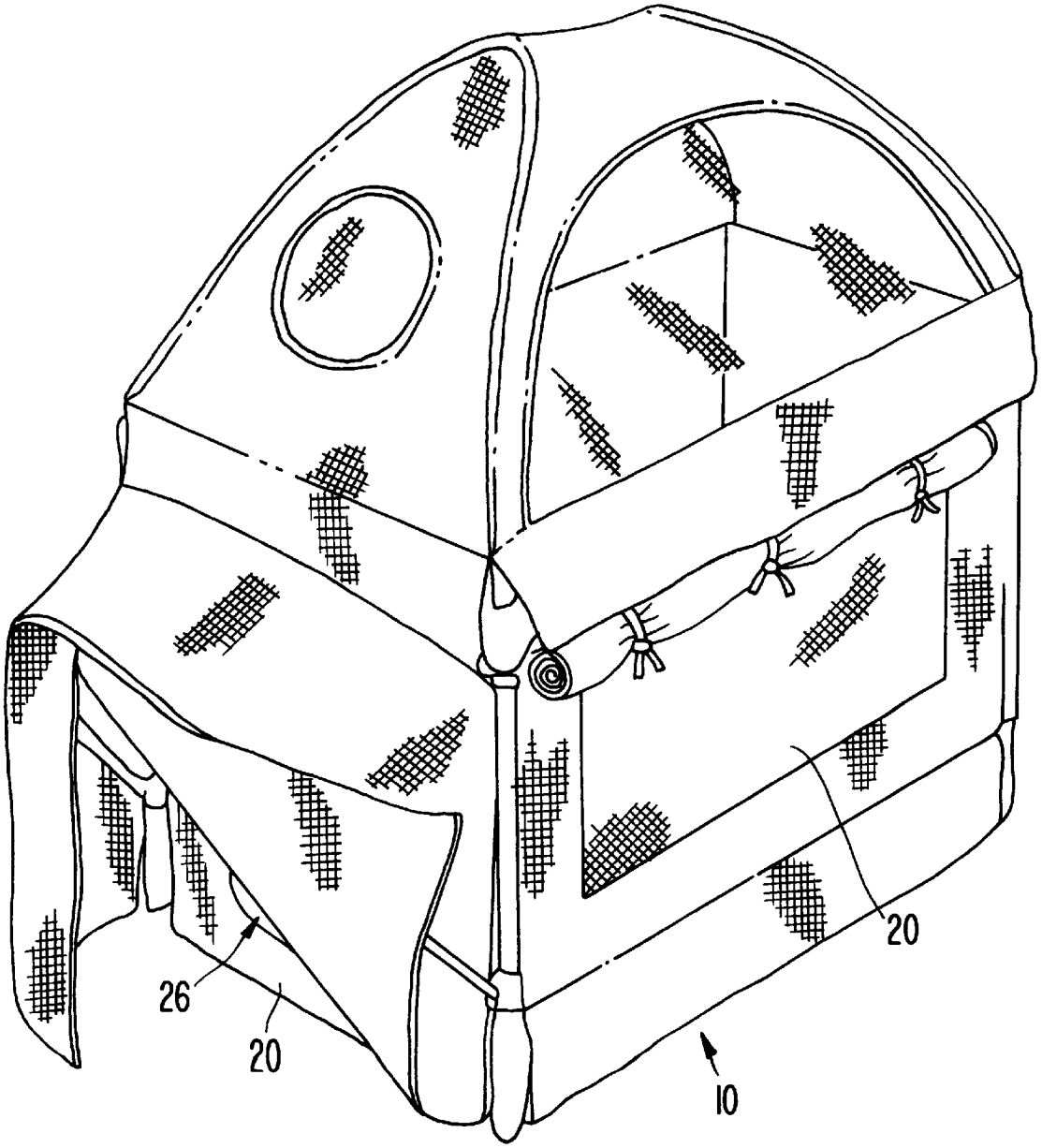
FIG. 1 is a perspective view of the playyard made in accordance with the present invention showing a canopy and an awning attached thereto.

A playyard made in accordance with the concepts of the present invention is indicated generally by the numeral 10 in the accompanying drawings. The playyard is an articulated structure provided with fabric-covered panels that is foldable for storage and/or portability. Such a foldable playyard is shown and described in U.S. Pat. No. 4,811,437, which is incorporated herein by reference. Of course, the present invention could be embodied in a playyard that is not foldable. As seen in FIG. 1, a canopy may be detachably mounted over the playyard 10. Additionally, an awning may be detachably mounted to one end of the playyard.

Figure 2:
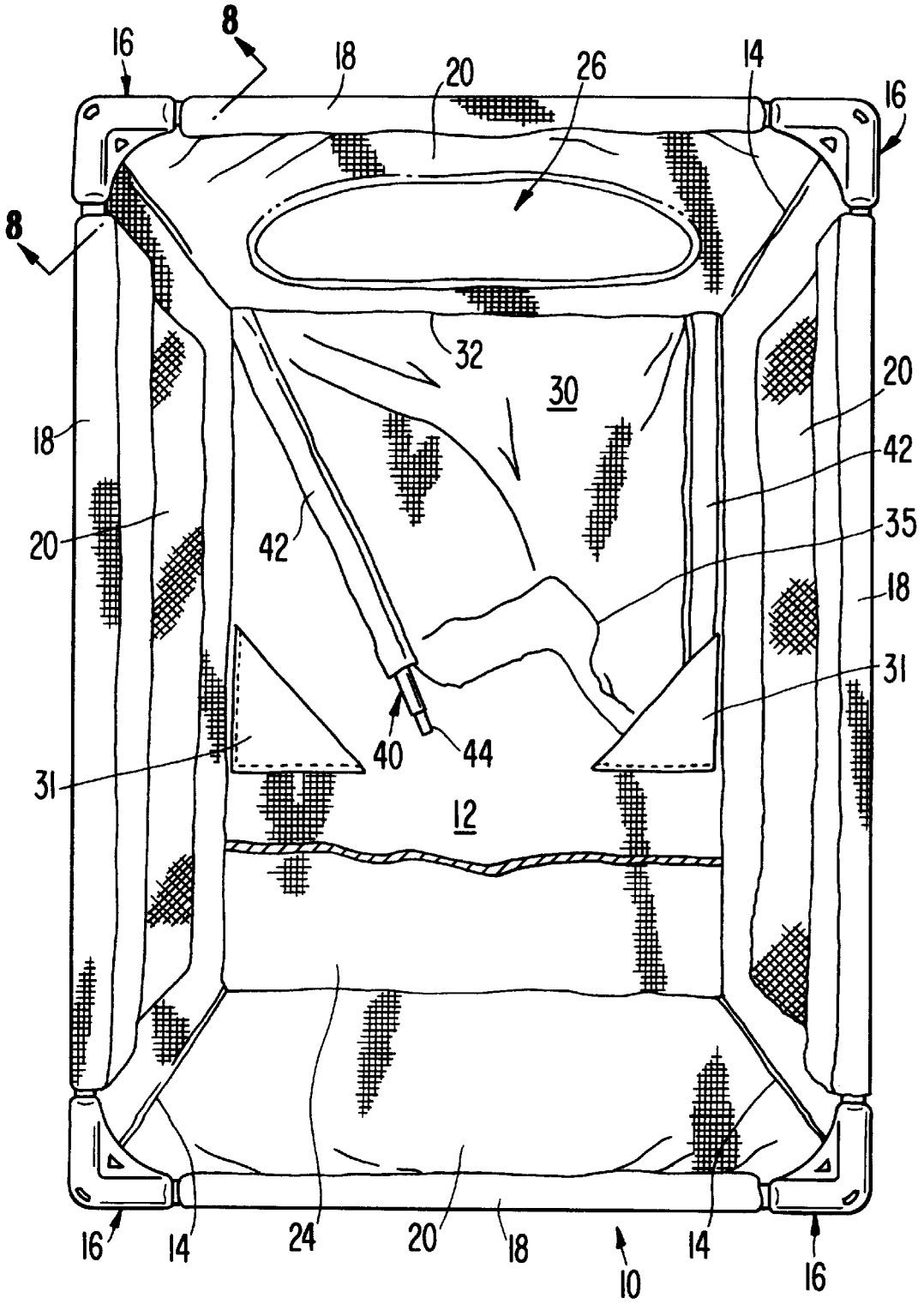
FIG. 2 is a top view of the playyard showing a door panel in an open position.
Figure 3:
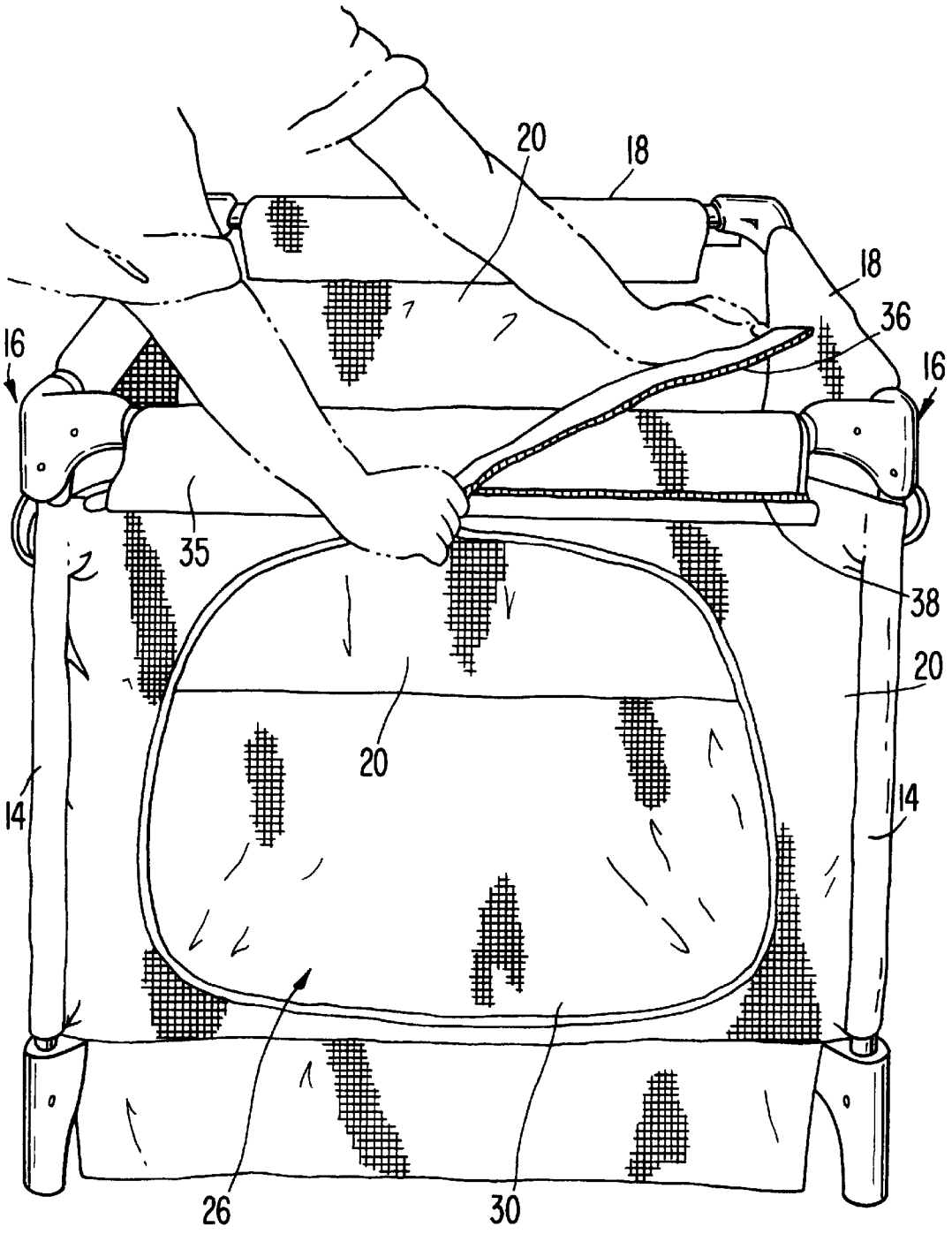
FIG. 3 is an end view of the playyard showing the first step in moving the door panel away from an opening in one of the side panels.
Figure 4:
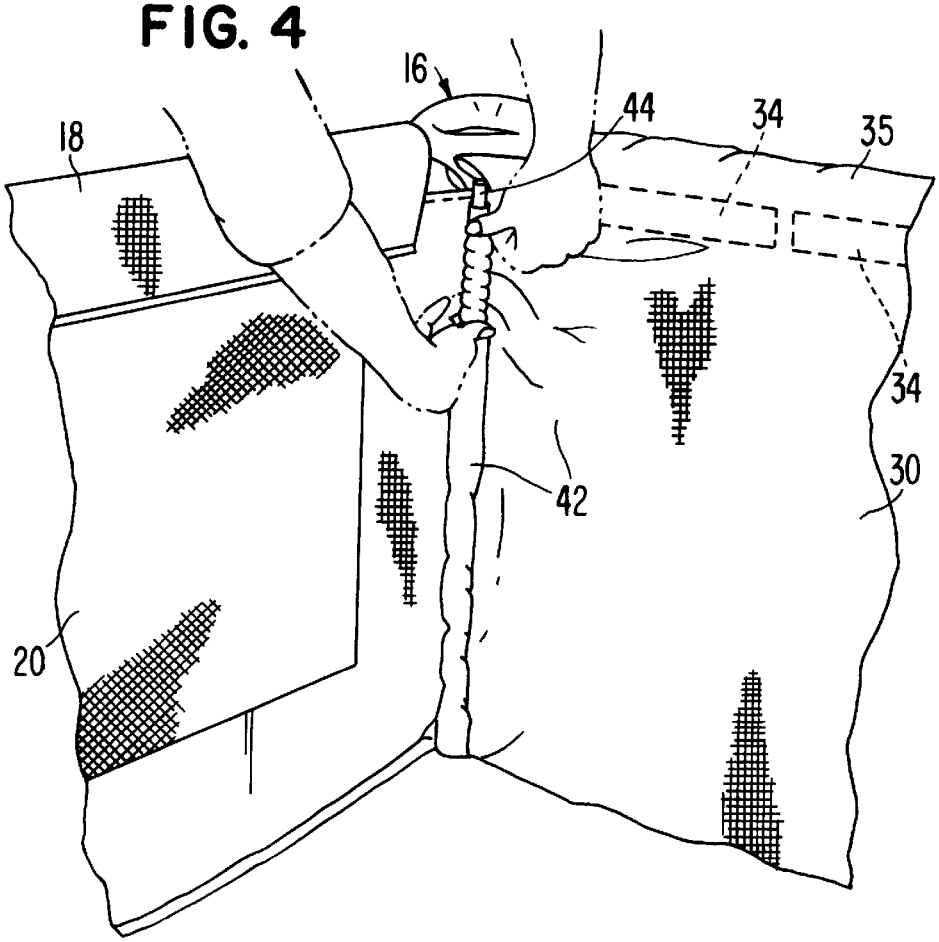
FIG. 4 is a partial perspective drawing showing an individual disengaging a tube assembly which holds the door panel in a closed position.

As best seen in FIGS. 2–4, playyard 10 includes a lower support structure and foot assembly which provides a floor 12 from which upwardly extends a plurality of corner posts 14. A post-rail corner 16 is disposed on top of each post 14 to connect side rails 18. A plurality of side panels 20 are provided between floor 12, posts 14, and rails 18 in a manner well known in the art. Typically, side panels 20 are constructed of mesh-type fabric with padding placed over or adjacent rails 18 and posts 14. A mattress pad 24 covers floor 12 to provide a rigid support surface and padding over the supporting structure and to provide comfort for the infant or toddler.

At least one of side panels 20 is provided with an opening 26. Opening 26 is sized to be large enough to allow a child to go in and out of the playyard 10 while still providing some surrounding fabric or padding.

A door panel 30 selectively covers opening 26 and is pivotable at a hinge 32. Door panel 30 is made from a fabric similar to that used for side panels and is provided with padding along the edges not associated with hinge 32. In the preferred embodiment, hinge 32 is sewn to floor 12 between side panels 20 adjacent the panel with opening 26. It will be appreciated, however, that hinge 32 could be provided in another location, such as along the length of one of the other side panels so that the door panel 30 is placed adjacent a side panel when the opening 26 is exposed. In the preferred embodiment, a pair of pockets 31 are sewn onto floor 12 such that corresponding top corners of door panel 30 are received therein. With door panel 30 placed upon floor 12, it may then be covered by the mattress pad 24.

Door panel 30 provides a top edge 33 which may receive a pair of slats 40 therein. Top edge 33 is positionable just under side rail 18 above opening 26. A flap 35 extends from top edge 33 and provides a half zipper 36. Flap 35 folds over the top of rail 18 and mates with a half zipper 38 on an exterior side of end panel 20 provided with the opening 26. Other fastening devices could be used in place of the zipper. Slats 34 provide structural stability to the door panel 30 when covering the opening 26.

A tube assembly 40 is sewn into edges 42 of door panel 30. It will be appreciated that tube assemblies 40 are moveable with door panel 30 at hinge 32. Each tube assembly 40 has a spring-loaded plunger 44 that engages an underside 46 of corner 16. Accordingly, when door panel 30 is pivoted to a position that covers the opening 26, tube assembly 40 is held in place by post-rail corner 16. Of course, other fastening devices for securing door panel 30 to side panel 20 with the opening 26 may be employed, such as buttons, zippers, hook-loop fasteners, and the like. An alternative construction to a spring-loaded plunger would be where the end of the tube assembly is frictionally engaged by the corner.

Figure 5:
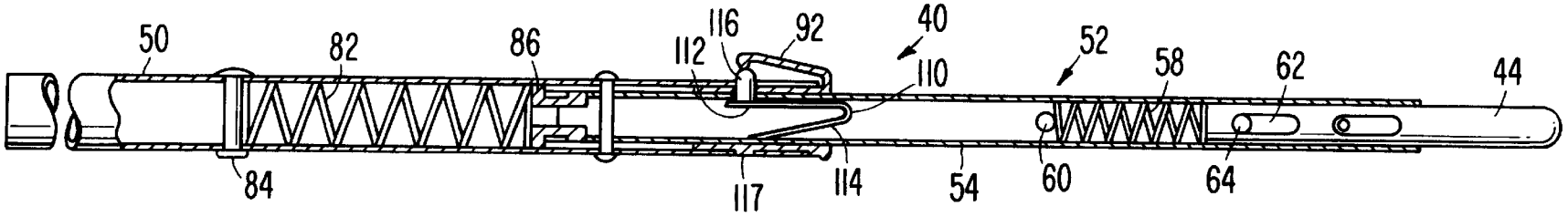
FIG. 5 is a partial, cross-sectional view of the tube assembly in its normal position.
Figure 6:
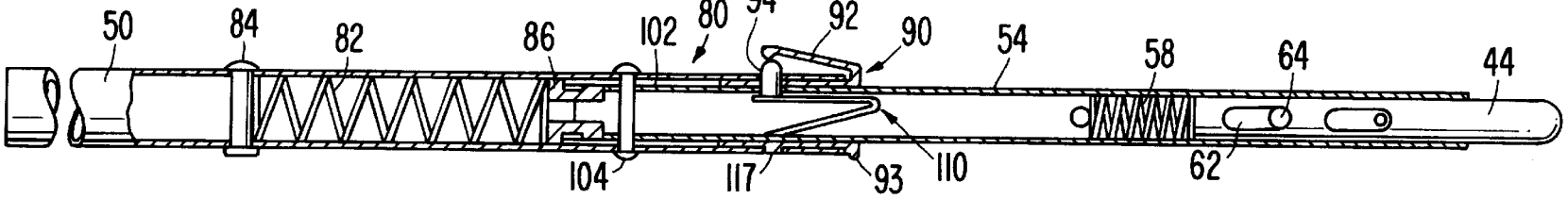
FIG. 6 is a partial, cross-sectional view of the tube assembly showing a plunger partially compressed.
Figure 7:
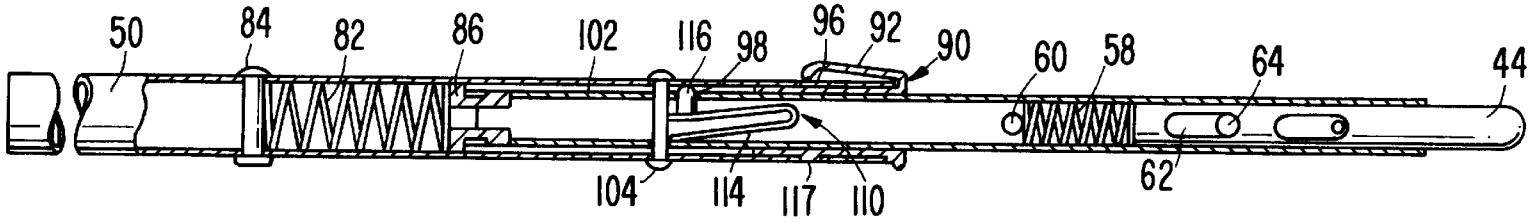
FIG. 7 is a partial, cross-sectional view of the tube assembly showing the plunger partially compressed and a retraction assembly activated.

As best seen in FIGS. 5–7, tube assembly 40 includes a bottom tube 50 which telescopically and slidably receives a corner engagement assembly 52. Assembly 52 includes an inner tube 54 which carries plunger 44 that is supported by a spring 58. A spring rivet 60 extends transversely through inner tube 54 and holds spring 58 in position. Plunger 44 includes a slot 62 along the length thereof. A plunger rivet 64 extends transversely through inner tube 54 and through slot 62 to limit the travel of the plunger 44 within inner tube 54. In its normal position, spring 58 exerts a force on plunger 44 to extend a tip of the plunger outwardly from the open end of inner tube 54.

Figure 8:
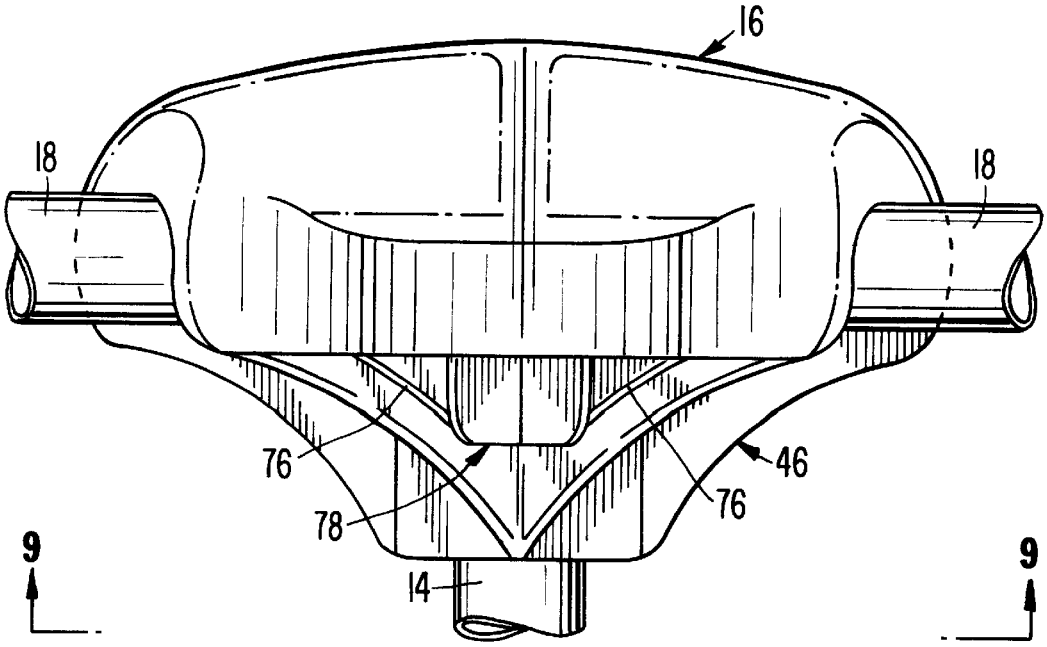
FIG. 8 is an elevational view of an playyard corner viewed from within the playyard.
Figure 9:
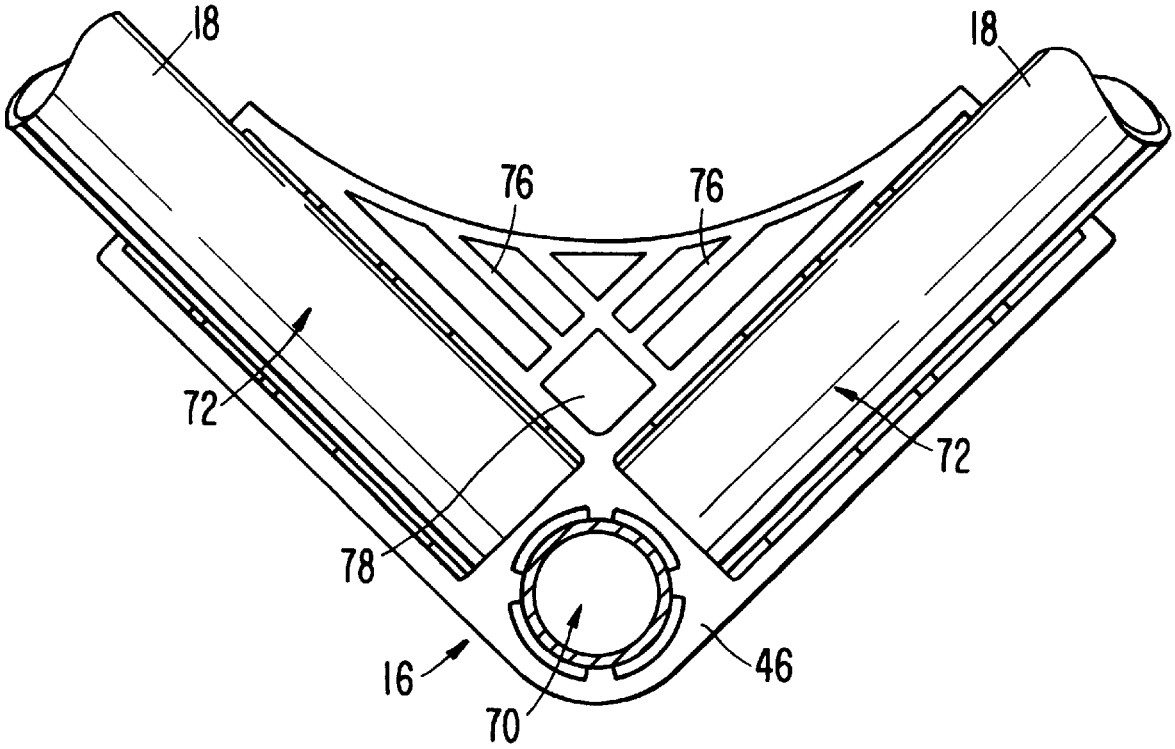
FIG. 9 is a bottom view of the playyard corner taken substantially along line 9—9 of FIG. 8.

When door panel 30 is in a closed position, plunger 44 engages an underside 46 of corner 16. As best seen in FIGS. 8 and 9, underside 46 provides a post hole 70 for receiving corner post 14. Adjacent post hole 70, at substantially right angles to one another, are a pair of rail slots 72 for receiving adjacent rails 18. Beside each rail slot 72 is a ramp 76, wherein both ramps intersect at a post pocket 78. Accordingly, as tube assembly 40 is raised to engage corner 16, plunger 44 impinges upon either one of ramps 76 and compresses spring 58. Accordingly, plunger 44 slidably moves within inner tube 54 by virtue of slot 62. As plunger 44 enters into post pocket 78, the compressive force upon spring 58 is released and returns plunger 44 to its normal extended position such that it is received within post pocket 78. The above process is repeated for the other tube assembly 40 to hold door panel 30 in position over opening 26. To further secure door panel 30 over opening 26, the half zippers 36 and 38 are mated. At this time, mattress pad 24 is installed over floor 12 and playyard 10 is employed for use as an enclosed play area.

When it is desired to convert the playyard from an enclosed structure to an accessible play area, the zipper halves 36 and 38 are unmated and mattress pad 24 is temporarily removed. Since a substantial portion of plunger 44 is received within post pocket 78, a retraction assembly 80 is provided in tube assembly 40. In particular, retraction assembly 80 allows for inner tube 54 to move slidably downward with respect to bottom tube 50. This eliminates the need to depress plunger 44 with one's fingers.

Retraction assembly 80 includes a retraction spring 82 supported by a rivet 84 which transversely extends through bottom tube 50. A spring corner 86 is placed on retraction spring 82 opposite rivet 84. Accordingly, inner tube 54 is biasingly supported by spring 82. A bushing 90 is received on the open end of bottom tube 50 and is disposed between an interior surface of bottom tube 50 and the exterior surface of inner tube 54. A deflectable member 92 extends from a rim 93 of bushing 90 and is angularly directed away from inner tube 54. Bushing 90 has a hole 94 that is aligned with an outer tube hole 96 provided by bottom tube 50. Inner tube 54 has an inner tube hole 98 that is aligned with outer tube hole 96 and hole 94. Inner tube 54 is also provided with an elongate through slot 102 along the length thereof. A rivet 104 slidably interconnects inner tube 54 within bottom tube 50 through inner tube slot 102. Rivet 104 and inner slot 102 allow slidable movement of inner tube 54 within bottom tube 50. Travel of inner tube 54 is limited by the length of slot 102.

A V-spring 110 is received in the end of inner tube 54 opposite plunger assembly 44. V-spring 110 includes a flat tine 112 and an angle tine 114 which must be compressed to enter the inner tube 54. A push button 116 extends from flat tine 112 and is received within aligned holes 94, 96, and 98. Accordingly, the push button 116 is placed adjacent the deflectable member 92. Bushing 90 has a nub 117 that engages outer tube 50 to prevent rotation of the bushing.

When door panel 30 is to be moved away from opening 26, the caregiver needs to first operate retraction assembly 80. This is done by finding and depressing deflectable member 92 with one hand. This pushes push button 116 below the interior surface of bottom tube 50. At this time, the caregiver grasps inner tube 54 with their other hand and pushes it downwardly into bottom tube 50. Accordingly, corner 86 compresses spring 82 and slot 102 moves along rivet 104. As soon as the tip of plunger 44 is removed from post pocket 78, the caregiver directs tube assembly 40 away from corner 16 and places it on floor 12. The above process is then repeated for the other tube assembly such that door panel 30 is laid flat on the floor 12. Plunger assemblies 44 are then placed into the pockets 31 and mattress pad 24 is placed thereover.

From the foregoing, it can be seen that playyard 10 is convertible between an enclosed play area to a play area that allows for entry and exit through a side. The playyard is structured such that only a caregiver can control movement of the door panel in a safe and efficient way. When closed, the door panel is secured by opposed tube assemblies and by a zippered flap.

In view of the foregoing, it should thus be evident that a playyard for children to be used as either a closed playyard or accessible play yard as described herein accomplishes the objects of the present invention and otherwise substantially improves the art.

What is claimed is:

1. A playyard, comprising:

a floor;

side panels extending upwardly from said floor to provide an enclosure, at least one of said side panels having an opening therethrough;

a pivotal door panel for selectively covering said opening to preclude access to and from said enclosure;

posts extending upwardly from said floor to support said side panels;

rails at a top edge of each said side panel;

a corner connecting each said post to intersecting rails; and a pair of tube assemblies spaced apart from one another and secured to said door panel, said tube assemblies engaging corresponding corners when said door panel covers said opening.

2. The playyard according to claim 1, wherein said door panel substantially covers said opening and said side panel in a covering position.

3. The playyard according to claim 1, wherein said door panel lays substantially flat on the floor in an open position.

4. The playyard according to claim 1, further comprising a half zipper at an edge of said door panel and a mating half zipper on an exterior side of said side panel with said opening, wherein said door panel is pivotable within said enclosure and held in a covering position by mating said half-zipper to said mating half zipper.

5. The playyard according to claim 1, further comprising at least one slat carried at an edge of said door panel opposite a pivot edge of said door panel.

6. A playyard, comprising:

a floor;

side panels extending upwardly from said floor to provide an enclosure, at least one of said side panels having an opening therethrough;

a door panel, having a pivot, for selectively covering said opening to preclude access to and from said enclosure;

posts extending upwardly from said floor to support said side panels;

rails at a top edge of each said side panel;

a corner connecting each said post to intersecting rails; and a pair of tube assemblies spaced apart from one another and secured to said door panel, said tube assemblies engaging corresponding corners when said door panel covers said opening, each said corresponding corner having an underside with a plunger pocket, wherein each said tube assembly has a spring-biased plunger at an end opposite said door panel's pivot, said plunger receivable in said plunger pocket.

7. The playyard according to claim 6, wherein said underside of said corner provides a ramp surface lead-in to said plunger opening to compress said spring-biased plunger.

8. The playyard according to claim 7, wherein said tube assembly comprises an outer tube slidably receiving an inner tube, wherein an exposed end of said inner tube carries said plunger assembly, and wherein said inner tube is selectively held within said outer tube.

9. The playyard according to claim 8, wherein said inner tube further comprises a V-spring having a push button, said inner tube and said outer having holes aligned with one another and receiving said push button, wherein depression of said push button allows said inner tube to slidably move within said outer tube to allow said plunger assembly to be disengaged from said plunger pocket.

10. A playyard, comprising:

a floor;

side panels extending upwardly from said floor to provide an enclosure, at least one of said side panels having an opening therethrough;

a pivotal door panel for selectively covering said opening to preclude access to and from said enclosure; and a floor pocket formed on said floor for retaining said door panel when removed from said opening.

* * * * *